US011071352B2

(12) United States Patent
Sykes

(10) Patent No.: US 11,071,352 B2
(45) Date of Patent: Jul. 27, 2021

(54) SHOE AND SHOE ORNAMENTING DEVICES

(71) Applicant: Riomar IP, LLC, Pampa, TX (US)

(72) Inventor: William Lange Sykes, Vero Beach, FL (US)

(73) Assignee: RiomarIP, LLC, Pampa, TX (US)

( * ) Notice: Subject to any disclaimer, the term of this patent is extended or adjusted under 35 U.S.C. 154(b) by 0 days.

(21) Appl. No.: 14/539,746

(22) Filed: Nov. 12, 2014

(65) Prior Publication Data

US 2015/0128454 A1 May 14, 2015

Related U.S. Application Data

(60) Provisional application No. 61/903,208, filed on Nov. 12, 2013.

(51) Int. Cl.
*A43B 23/24* (2006.01)

(52) U.S. Cl.
CPC ..... *A43B 23/24* (2013.01)

(58) Field of Classification Search
CPC ..... A43B 3/24; A43B 3/242; A43B 23/24; A43C 11/24
USPC ..... 36/100, 132, 136; 2/245
See application file for complete search history.

(56) References Cited

U.S. PATENT DOCUMENTS 1,660,215 A * 2/1928 Stafford et al. ..... 36/58.5
D86,888 S 5/1932 Metcalf
2,010,853 A 8/1935 Dyer
2,015,616 A 9/1935 Clark
2,097,465 A 11/1937 Morrison
2,124,912 A 7/1938 Ehmann
2,209,007 A * 7/1940 Stevenson ..... F16G 15/06 411/946
2,259,217 A * 10/1941 Stevenson ..... F16G 15/06 411/217
2,259,880 A 10/1941 Ehmann
2,729,058 A 1/1956 Dock
3,208,196 A 9/1965 Ferguson
3,224,185 A 12/1965 Grim et al.
D213,086 S 1/1969 Aigner
3,601,909 A * 8/1971 Amendola ..... 36/44
3,745,743 A 7/1973 Sprenger
3,811,270 A 5/1974 Smith
(Continued)

OTHER PUBLICATIONS

Spooky Boutique Black Veggie Loafer Creepers, announced Nov. 2012, [online], site visited Mar. 16, 2015. Available from Internet, <URL: http://www.spookyboutique.com>.
(Continued)

*Primary Examiner* — Sharon M Prange
(74) *Attorney, Agent, or Firm* — Bonini IP Law, LLC; Frank J. Bonini, Jr.

(57) ABSTRACT

A shoe and shoe ornamenting device is shown. The shoe is shown in an exemplary embodiment, depicted as a preferred loafer having attachment points for attachment of a shoe ornamenting device thereto. The attachment points preferably comprise a loop of material that serves as a point of connection for the shoe ornamenting device. A replaceable band is secured to a first shackle and a second shackle, the shackles being removably secured, respectively, to loops of material at each bridge end of the shoe, using a fastener, such as a pin, which secures the shackle to a loop.

9 Claims, 3 Drawing Sheets

(56) References Cited

U.S. PATENT DOCUMENTS

| | | | | |
|---|---|---|---|---|
| 3,893,725 | A * | 7/1975 | Coulter | B65D 45/02 220/318 |
| 3,902,731 | A * | 9/1975 | Fagen | A47C 1/14 280/812 |
| 4,068,960 | A | 1/1978 | Swager | |
| 4,172,330 | A * | 10/1979 | Kao | 36/11.5 |
| D265,173 | S | 6/1982 | Brooks | |
| 4,733,439 | A * | 3/1988 | Gentry | 206/338 |
| 5,114,260 | A | 5/1992 | Hart et al. | |
| 5,214,940 | A | 6/1993 | Capifali | |
| 6,256,793 | B1 | 7/2001 | Arias | |
| 6,397,868 | B1 * | 6/2002 | Smith | A45B 5/00 135/66 |
| 6,425,229 | B2 | 7/2002 | Sprenger | |
| 6,715,186 | B1 * | 4/2004 | Huang | A41B 9/002 2/271 |
| D543,678 | S | 6/2007 | Boas et al. | |
| D562,719 | S | 2/2008 | Giannini | |
| 7,393,033 | B1 | 7/2008 | Bisso, IV | |
| 7,448,823 | B2 | 11/2008 | Silva | |
| 7,819,721 | B1 * | 10/2010 | Messier | 450/86 |
| 7,938,712 | B2 * | 5/2011 | Maricevic | A41F 15/002 2/338 |
| 8,171,715 | B2 | 5/2012 | Segura | |
| 8,261,373 | B2 * | 9/2012 | Detsis | A44C 5/0053 2/300 |
| 8,402,677 | B2 * | 3/2013 | Houston | 36/136 |
| 9,144,295 | B2 * | 9/2015 | Schmoll et al. | |
| 2004/0200196 | A1 | 10/2004 | Hsi-Chang | |
| 2009/0300892 | A1 | 12/2009 | Yurman | |
| 2012/0159987 | A1 * | 6/2012 | Walchle | F16B 45/00 63/3.2 |
| 2012/0192460 | A1 * | 8/2012 | Barnhart | 36/136 |
| 2012/0201599 | A1 * | 8/2012 | Reppen | F16G 15/06 403/348 |
| 2013/0019381 | A1 * | 1/2013 | Lovell | 2/245 |
| 2014/0013627 | A1 * | 1/2014 | Stein et al. | 36/109 |
| 2014/0246346 | A1 * | 9/2014 | Franco | B60R 7/043 206/335 |
| 2015/0096109 | A1 * | 4/2015 | Nackowski | 2/245 |
| 2015/0201708 | A1 * | 7/2015 | Maddocks | 36/136 |
| 2015/0366294 | A1 * | 12/2015 | Riccardi | 36/136 |

OTHER PUBLICATIONS

Seawear Sealinks015 Gold Shackle Bracelet, announced Feb. 2009, [online], site visited Sep. 17, 2015. Available from Internet, <URS: http://www.seawear.com>.

* cited by examiner

SHOE AND SHOE ORNAMENTING DEVICES

BACKGROUND OF THE INVENTION

Field of the Invention

The present invention relates to the field of footwear, and more particularly to a device, method and system for ornamenting a shoe.

SUMMARY OF THE INVENTION

A shoe and shoe ornamenting device is shown. The shoe is shown in an exemplary embodiment, depicted as a preferred loafer having attachment points for attachment of a shoe ornamenting device thereto. The attachment points preferably comprise a band of material that serves as a point of connection for the shoe ornamenting device.

The shoe ornamenting device preferably spans across the last of the shoe, and, as shown is connected at the first attachment point and the second attachment point.

According to a preferred embodiment, the ornamenting device includes a connector having a body portion and a connecting portion that connects to the attachment point of the shoe. One preferred embodiment configures the attachment elements on the ends of the body portion (shown at each arm end thereof) and is secured with a securing element to the shoe attachment point. For example, the body is shown having a first arm and a second arm. Each arm has a threaded aperture there through. The securing element is shown according to one embodiment comprising a pin having a first end and a second end. The pin has threads which secure the pin to the threaded apertures for rapid attachment and removal of the securing element and ornamenting device body.

The body is connected to a feature element or connecting element, which is shown as a band spanning between the body of the first connector, and connecting with the body of a second connector. The second connector is shown attached to the second attachment point of the shoe, and is disposed on the opposite side of the shoe, as shown.

The connecting element may be configured having a preferred configuration where a curved body portion extends toward the center of the shoe, from a point of connection at one of the shoe attachment points. The connecting element preferably is secured by a matingly threaded pin, although other mechanisms may be used to secure the connecting element to the shoe attachment point.

The connecting element is removably secured to the shoe, so alternate or differently shaped connecting elements may be used. The connecting band also may be provided having different colors, or with different configurations.

The system permits a user to select from a different band and attach the band to the shoe, preferably to coordinate with the clothing of the wearer.

According to one embodiment, a shoe is provided having interchangeable decorative elements, including connecting bands from which to select, and connectors that connect the band to the shoe.

According to some embodiments, the shoe may be provided as a kit, with one or more bands, securing elements or pins, to provide a number of options for configuring the shoe.

FIGURE DESCRIPTIONS

DETAILED DESCRIPTION OF THE INVENTION

Referring to the figures, where a preferred exemplary embodiment of the invention is shown, two shackles are linked by various methods of design to form an interchangeable shoe ornament. The ornament then attaches to the bridge of the shoe to provide both, an aesthetic appeal as well as utilitarian, structural shoe support.

Figure 1:
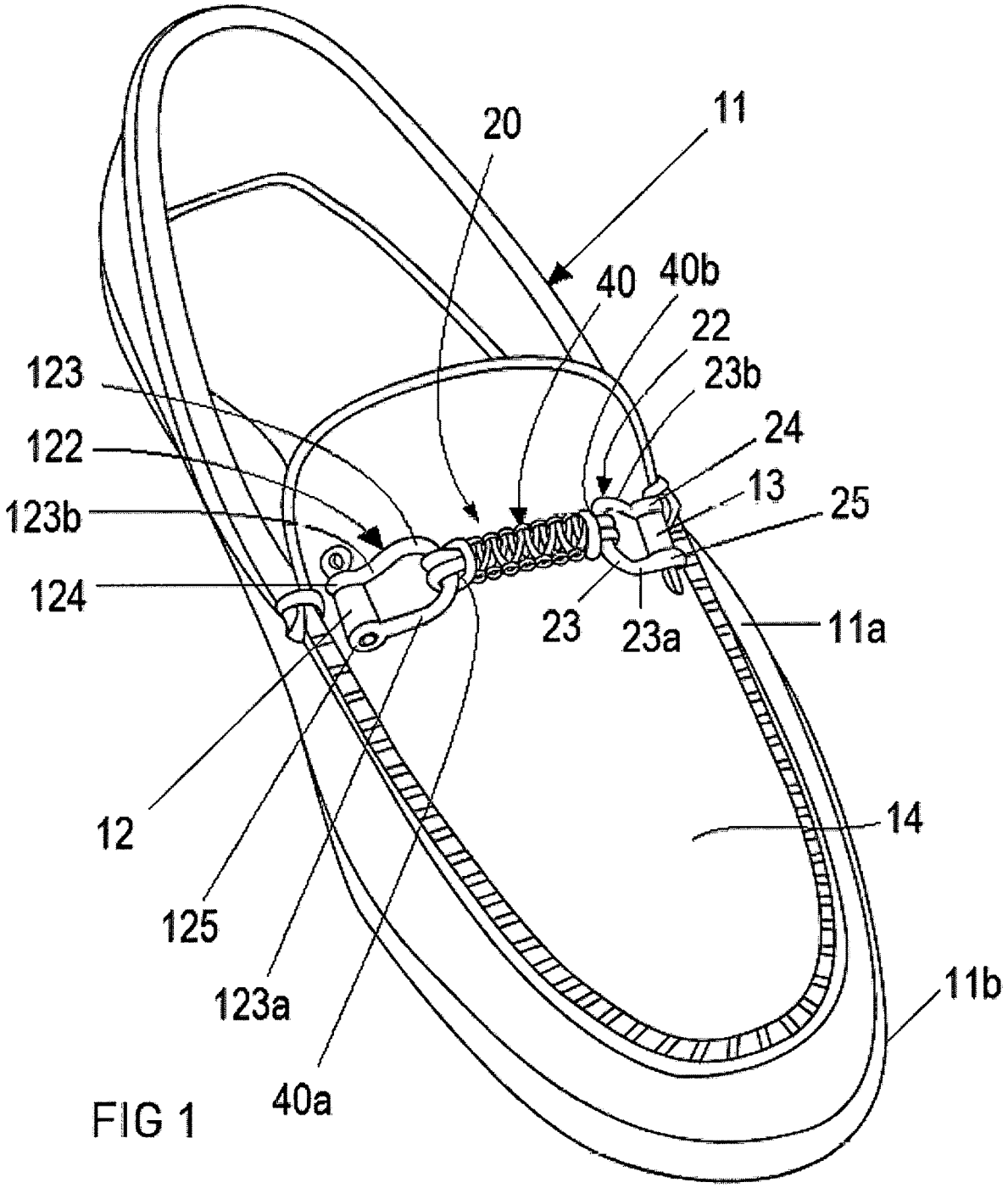
FIG. 1 is a perspective view of a shoe and shoe ornamenting device according to my present invention.

Referring to FIG. 1, a shoe embodiment of the invention is shown, with a shoe 11 that preferably has an upper 11*a* and a sole 11*b*. The shoe upper 11*a* preferably is made from leather, but also could be made from synthetic material. The sole 11*b* may be made from rubber, cork, leather, wood or other materials generally known and used for shoe soles.

As an example, two loops 12, 13, preferably made from shoe upper material (such as, preferably, leather), are sewn into the shoe pattern of the shoe 11, one loop 12 on the right and the other loop 13 on the left side.

The shoe 11 is provided having a shoe ornamenting device 20. The shoe ornamenting device 20 comprises a component that spans across the shoe bridge or vamp 14. The shoe ornamenting device 20 preferably spans across the shoe 11, and, as shown is connected at one side thereof at the first attachment point, which is the first loop 12 and, at the other side thereof, at the second attachment point, which is the second loop 13. The shoe ornamenting device 20 is removably connectable on the shoe, and, as illustrated in the embodiment, connects to the loops 12,13.

The shoe ornamenting device 20, as illustrated according to a preferred embodiment, preferably includes a connector 22 having a body portion 23 and a connecting portion comprising attachment elements 24, 25 that connect to the attachment point of the shoe (such as the loops 12, 13). One preferred embodiment, as shown in the figures, configures the attachment elements 24, 25 at each end of the body portion 23 (shown at each aim end thereof) and is secured with a securing element to the shoe attachment point. For example, the body 23 is shown having a first arm 23*a* and a second aim 23*b*. Each arm 23*a*,23*b* has a threaded aperture 28 there through. The securing element is shown according to one embodiment comprising a pin 30 having a first end and a second end. The pin 30 has threads 31 which secure the pin 30 to the threaded apertures 28 for easy attachment and removal of the securing element or pin 30 to and from the connector 22, and ornamenting the device 20 with one or more of the bands 40.

The connector body 23 is shown connected to a feature element or connecting element, which is illustrated comprising a band 40 spanning between the body 23 of the first connector 22, and connecting with the body 123 of a second connector 122. The second connector 122 is shown attached to the second attachment point of the shoe, the loop 12 and is disposed on the opposite side of the shoe, as shown.

The pin 30 is removably secured to the shoe 11. The connecting band 40 also may be provided having different colors, or with different configurations. According to preferred embodiments, the connecting band 40 may be elastic or stretchable to accommodate different sizes (particularly widths) of shoes. According to a preferred embodiment, the band 40 preferably includes a first connecting end 40*a* and a second connecting end 40*b*, the connecting ends 40*a*,40*b* being provides to connect the band with the respective connectors 22,122. According to preferred embodiments, the connecting ends 40*a*,40*b* are configured as loops through which the band may pass to secure to the shackle or connector 22,122.

Figure 2:
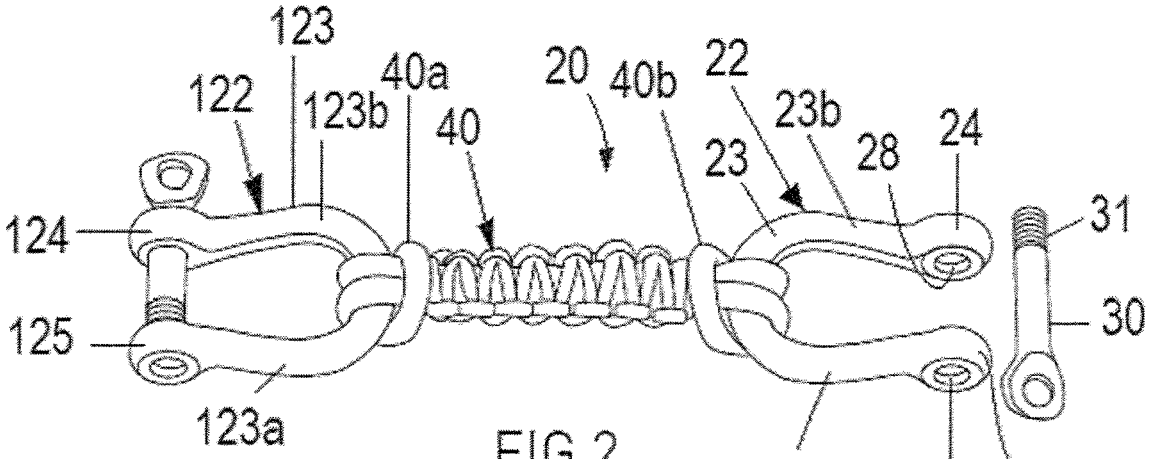
FIG. 2 is a perspective view of the of the shoe and shoe ornamenting device of FIG. 1, with the ornamenting feature shown separately from the shoe, and with one of the pins of the ornamenting feature shown uninstalled.
Figure 3:
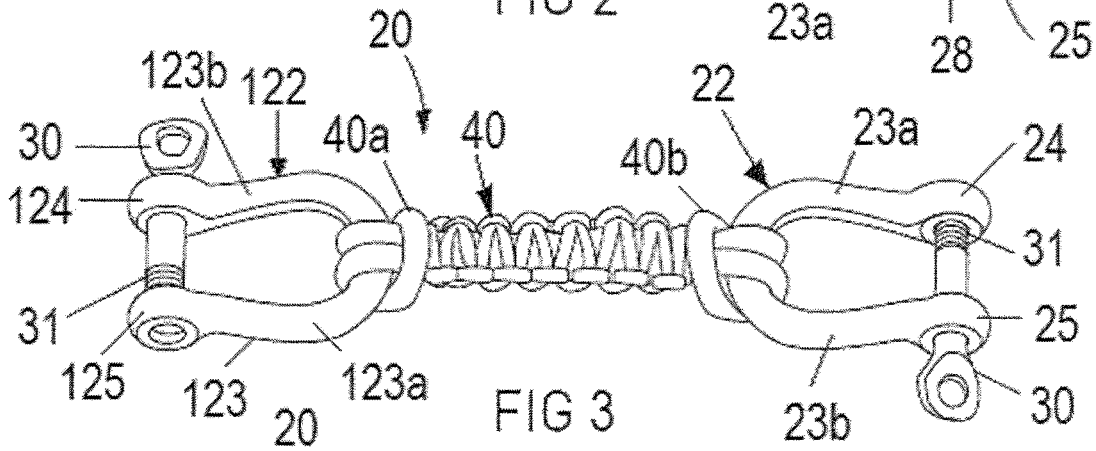
FIG. 3 is a perspective view of the of the shoe and shoe ornamenting device of FIG. 1, with the ornamenting feature shown separately from the shoe, and with both pins shown installed.
Figure 4:
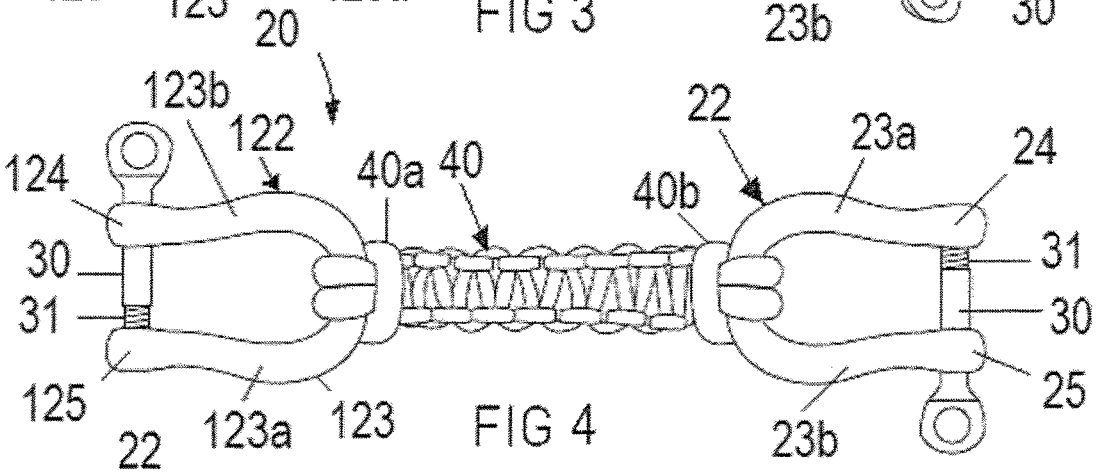
FIG. 4 is a top plan view of the shoe and shoe ornamenting device of FIG. 1, with the ornamenting feature shown separately from the shoe.
Figure 5:
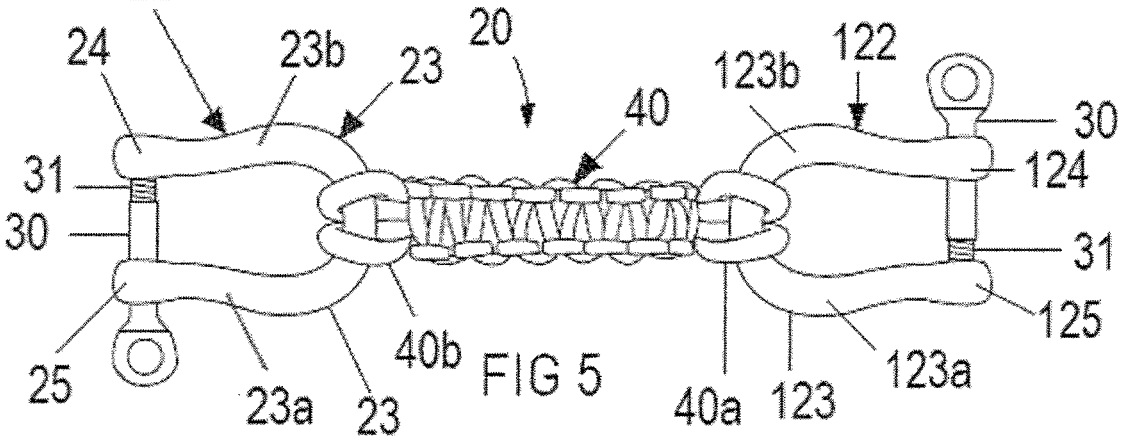
FIG. 5 is a bottom plan view of the shoe and shoe ornamenting device of FIG. 1, with the ornamenting feature shown separately from the shoe.
Figure 6:
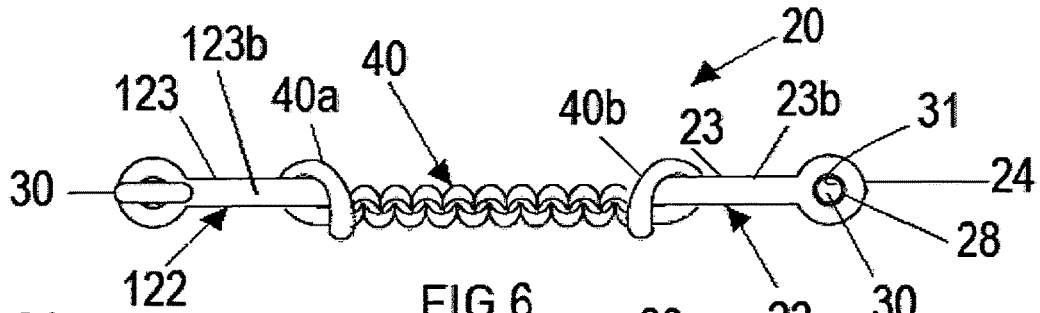
FIG. 6 is a front elevation view thereof, with the ornamenting feature shown separately from the shoe.
Figure 7:
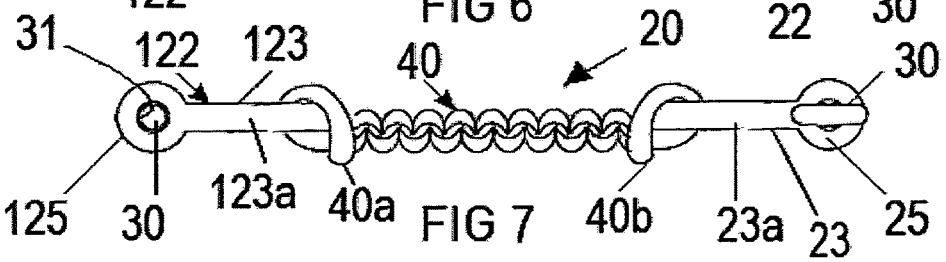
FIG. 7 is a rear elevation view thereof with the ornamenting feature shown separately from the shoe.
Figure 8:
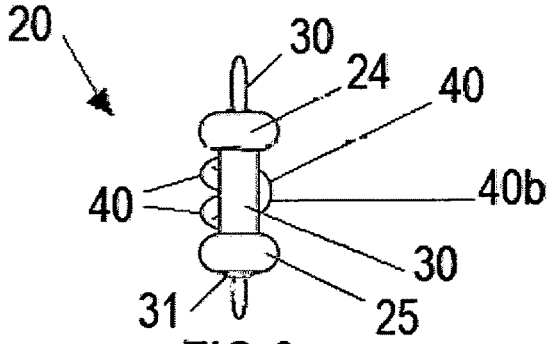
FIG. 8 is a right side elevation view thereof with the ornamenting feature shown separately from the shoe, the left side elevation view being a mirror image thereof.
Figure 9:
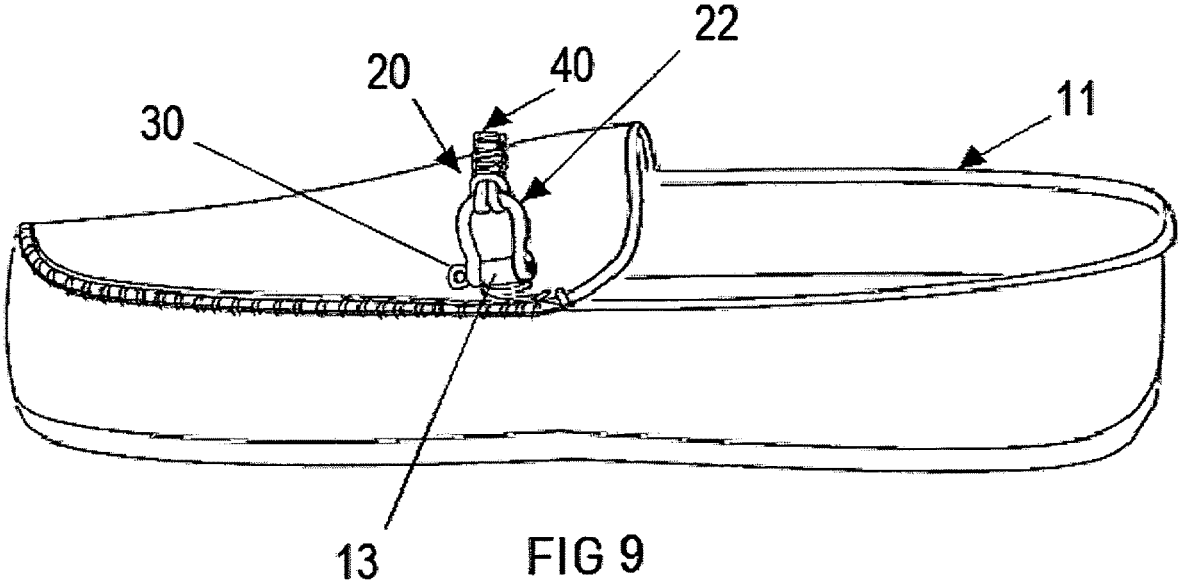
FIG. 9 is a right side elevation view of the shoe and shoe ornamenting device of FIG. 1.

The system, device and method involve installing and removing the ornamenting device 20 on and from the shoe 11. Installing the ornamenting device 20 onto the shoe may be done by connecting the ornamenting device connectors 22,122 with the band 40 already attached to each connector 22,122, or alternately, by installing one connector 22,122 at a time, where the band 40 may be installed by slipping it over one of the attachment elements 24,25 or 124,125 of a respective connector 22,122. According to a preferred installation method, the ornamenting device may be installed by inserting the threaded shackle pin 30 through the initial shackle pin fitting 28 (see FIG. 2) on the attachment element 25, then through the leather loop 13, and screwed into the final threaded shackle pin fitting bore of the attachment element 24. The same is repeated for the shackle connector 122 on the other side, into the open leather loop 12. The band 40 may be installed on the connector 22,122 during the installation process, either over an end of a connector 22,122 or looping the band onto the connector body.

As a design advantage, the functional aspect of the two shackles 22, 122 (as part of the ornament) allows the shoe wearer to easily change, swap or replace the (ornament) as they see fit. This allows the wearer to accessorize or customize a single pair of shoes as often as they please.

Two shackles 22, 122 held together by any method of design attached to a shoe's bridge 14 by a threaded shackle pin 30 or any other method of attachment to shoe 11.

According to preferred embodiments, the shackles 22, 122 and (ornament as a whole 20) are meant to convey a "Nautical" feel and the impression given is part of the overall design concept.

The connector, such as, for example, the pin 30 may be removed from the shackle attachment element 24, 25 to release the shackle 22 from its connection with the shoe 11, such as from the loop 13. The band 40 may be removed from the shackle 22 and replaced with an alternate band (e.g., band color, etc.).

In one exemplary embodiment, the shoe ornamenting device comprises a connector 22 having a body portion 23 with attachment means 24, 25 for attachment to an attachment portion 13 of a shoe 11, a securing element 30 for releasably securing the connector 22 with the attachment portion 13 of the shoe 11; and an element 40 spanning between the connector body 23 of the first connector 22 and a connector body 123 of a second connector 122. The connectors 22,122 and pins 30 securing each connector 22, 122 on the shoe attachment portion 13,12, respectively, and each connector 22,122 to the band or spanning element 40, are releasable and allow for changing of the band 40.

The invention may include a system where a plurality of bands 40 are provided in a kit with a plurality of connectors or shackles and pins.

Although the preferred shoe embodiment is depicted as a loafer, the shoe ornamenting feature may be applied to other shoes, in particular, shoes provided with an attachment portion to which the connector may be secured. These and other advantages of my invention are shown and described in the drawing figures and in the appended claims.

The invention claimed is:

1. A shoe comprising:

a shoe body comprising a shoe upper having a first attachment portion and a second attachment portion; the shoe upper having a side wall portion with an edge, and having a top portion with an edge, the top portion edge joining with the side wall portion edge, and wherein the first attachment portion and a second attachment portion are provided on the top portion;

an ornamenting device removably connectable with said shoe body, said ornamenting device comprising:

a first connector having a body portion with attachment means for attachment to the first attachment portion of the shoe body;

a first securing element for securing the first connector with the first attachment portion of the shoe body;

a second connector having a body portion with attachment means for attachment to the second attachment portion of the shoe body;

a second securing element for securing the second connector with the second attachment portion of the shoe body; and a spanning element spanning between the connector body portion of the first connector and the connector body portion of the second connector; wherein the spanning element has connecting ends that are configured as loops through which the spanning element may pass to secure itself to the first connector body portion, said connecting ends comprising a first connecting end and a second connecting end;

wherein said first connector comprises a first threaded pin shackle having a curved body portion, wherein said second connector comprises a second threaded pin shackle having a curved body portion, wherein said first securing element comprises a first threaded pin, and wherein said second securing element comprises a second threaded pin;

wherein each one of said first connector and said second connector is securable to and removable from a respective one of said first and second attachment portions of the shoe in two different ways, including a first way in which the first connector or second connector is removably detachable from a respective one of said shoe first and second attachment portions, and from the spanning element; and in a second way in which the first connector or second connector is removably detachable from its respective one of said shoe first or second attachment portion with the spanning element remaining connected to the said first or second connector; and wherein each of said first threaded pin and second threaded pin is configured to releasably secure the spanning element to the respective shoe first attachment portion and shoe second attachment portion, each threaded pin having a head and a shaft, the shaft joining with the head, each said shaft having threads thereon; wherein each said threaded pin shackle has at least one threaded aperture for engaging with the threads of each said respective threaded pin, and wherein said threads of said shaft are matingly threaded to releasably secure the respective threaded pin to the threaded aperture of said respective threaded pin shackle;

wherein each of said first threaded pin shackle and said second threaded pin shackle has a pair of arms having opposing ends that define a space therebetween, and wherein said at least one threaded aperture of each of said first threaded pin shackle and said second threaded pin shackle is provided in at least one of said arm opposing ends; and wherein each of said shoe first attachment portion and said shoe second attachment portion are mounted to said shoe and are sized to fit between the opposing arms of said threaded pin shackle, and wherein each of said first attachment portion and said second attachment portion is configured as a loop defining a longitudinal opening therethrough;

wherein each said threaded pin passes through a respective pair of the arm opposing ends of said first threaded pin shackle or said second threaded pin shackle, and a respective one of said shoe first attachment portion longitudinal opening and said shoe second attachment portion longitudinal opening;

wherein the first attachment portion loop is longitudinal and is oriented perpendicular to the spanning element and wherein the first attachment portion longitudinal opening is perpendicular to the spanning element, and wherein said first attachment portion loop has a length that defines the length of said longitudinal loop opening and fixes the shackle arms of said first threaded pin shackle in position against movement in the longitudinal direction;

wherein the second attachment portion loop is longitudinal and is oriented perpendicular to the spanning element and wherein the second attachment portion longitudinal loop opening is perpendicular to the spanning element, and wherein said second attachment portion loop has a length that defines the length of said longitudinal loop opening and fixes the shackle arms of said second threaded pin shackle in position against movement in the longitudinal direction;

wherein said shaft of said first threaded pin is disposed within said longitudinal loop opening of said first attachment portion loop, and wherein said shaft of second threaded pin is disposed within said longitudinal loop opening of said second attachment portion loop; and wherein said spanning element first end is connected to said first threaded pin shackle curved body portion, said spanning element first end being laterally spaced apart from said first attachment portion loop; and wherein said spanning element second end is connected to said second threaded pin shackle curved body portion, said spanning element second end being laterally spaced apart from said second attachment portion loop.

2. The shoe of claim 1, wherein said first threaded pin shackle has a first threaded aperture and a second threaded aperture, and wherein said first arm has the first threaded aperture and wherein said second arm has the second threaded aperture, and wherein said first threaded pin is releasably securable to the threaded apertures of the first threaded pin shackle first and second arms.

3. The shoe of claim 2, wherein said spanning element spanning between the connector body portion of the first connector and the connector body portion of the second connector comprises a band, wherein each of the band connecting ends configured as a loop comprises a first band loop at one connecting end thereof and a second band loop at the other connecting end thereof; wherein one said threaded pin shackle connects said first band loop with said shoe first attachment portion, and wherein another said threaded pin shackle connects said second band loop with said second shoe second attachment portion.

4. The shoe of claim 1, wherein each said head of said first threaded pin and said second threaded pin comprises an enlarged portion.

5. The shoe of claim 2, wherein said first threaded pin passes through said first connector first arm threaded aperture, said shoe first attachment portion loop and said first connector second arm threaded aperture.

6. The shoe of claim 5, wherein said shoe second attachment portion loop fits within the pin space defined between said second connector arms, and wherein said second threaded pin passes through said second connector first arm threaded aperture, said shoe second attachment portion loop and said second connector second arm threaded aperture.

7. The shoe of claim 1, wherein said spanning element connecting ends are configured as loops that comprise a first end loop and a second end loop, and wherein said connecting element first end loop is retained at the shoe first attachment portion loop with said first connector, and wherein said connecting element second end loop is retained at the shoe second attachment portion loop with said second connector.

8. A shoe comprising:

a shoe body having a bottom, a top portion, and at least one side portion forming the sides of said shoe and having an upper edge, said top portion joining with said at least one side portion upper edge and defining the front length of said shoe, a first attachment portion provided on the top portion at a location near said side portion upper edge, and a second attachment portion provided on the top portion at a location near said side portion upper edge opposite to the side of the top portion on which said first attachment portion is provided, said first attachment portion comprising a longitudinal loop and said second attachment portion comprising a longitudinal loop;

an ornamenting device removably connectable with said shoe body, said ornamenting device comprising:

a first connector having a body portion with attachment means for attachment to the first attachment portion of the shoe;

a first securing element for securing the first connector with the first attachment portion of the shoe;

a second connector having a body portion with attachment means for attachment to the second attachment portion of the shoe;

a second securing element for securing the second connector with the second attachment portion of the shoe; and a spanning element spanning between the connector body of the first connector and the connector body of the second connector;

wherein at least one of said first connector and said second connector comprises a threaded pin shackle with a body, and wherein at least a respective one of said first securing element and said second securing element comprises a threaded pin;

wherein the spanning element has a first end with a first connecting loop and a second end with a second connecting loop; wherein said spanning element may pass through one of the first or second connecting loops to secure the spanning element to at least one of the first connector and second connector;

wherein each said threaded pin is releasably connectable to said threaded pin shackle body, and, when connected to said threaded pin shackle body, forms a boundary with said threaded pin shackle body to define a shackle perimeter with an inner opening surrounded by said perimeter, wherein said shackle perimeter releasably connects to a respective one of said spanning element first or second loops, and releasably connects to a respective one of the attachment portions of the shoe;

wherein said spanning element first connecting loop and second connecting loop are each releasably securable to one of the said threaded pin shackles by receiving therethrough said perimeter of said respective threaded pin shackle;

wherein each one of said threaded pin shackles is securable to and removable from a respective one of said shoe attachment portions in two different ways, including a first way in which the threaded pin shackle is removably detachable from a respective one of said shoe attachment portions, and from the spanning element; and in a second way in which the threaded pin shackle is removably detachable from its respective one of said shoe attachment portions with the spanning element remaining connected to the threaded pin shackle;

wherein each said respective threaded pin is releasable from its said respective threaded pin shackle body while said spanning element remains attached to the respective shackle body from which the pin is released;

wherein each said releasably connectable threaded pin has a single threaded attachment point disposed at a terminal end thereof for attachment to said threaded pin shackle body portion of a respective one of said threaded pin shackles.

9. The shoe of claim 8, wherein said spanning element comprises a unitary band.

* * * * *